US006050903A

United States Patent [19]

Lake

[11] Patent Number: 6,050,903

[45] Date of Patent: Apr. 18, 2000

[54] GOLF CLUB WITH IMPROVED COUPLING BETWEEN HEAD AND SHAFT

[76] Inventor: Connie Lake, 16336 Oxford Dr., Tinley Park, Ill. 60477

[21] Appl. No.: 09/082,571

[22] Filed: May 21, 1998

Related U.S. Application Data

[63] Continuation-in-part of application No. 08/789,643, Jan. 27, 1997, abandoned, which is a continuation-in-part of application No. 08/615,525, Mar. 11, 1996.

[51] Int. Cl.[7] ..... A63B 53/02; A63B 53/06

[52] U.S. Cl. ..... 473/244; 473/305; 473/307; 473/324; 473/350

[58] Field of Search ..... 473/305–315, 473/239, 296, 298, 299, 244–248, 324–339, 342–350

[56] References Cited

U.S. PATENT DOCUMENTS

| | | | |
|---|---|---|---|
| Re. 16,058 | 4/1925 | Jordan | 473/322 |
| D. 241,359 | 9/1976 | Taylor . | |
| 695,579 | 3/1902 | Parmele | 473/311 |
| 1,892,482 | 12/1932 | Cash, Jr. . | |
| 2,153,550 | 4/1939 | Cowdery . | |
| 2,219,670 | 10/1940 | Wettlaufer . | |
| 2,250,429 | 7/1941 | Vickery | 473/323 |
| 2,464,850 | 3/1949 | Crawshaw | 473/299 |
| 2,962,286 | 11/1960 | Brouwer . | |
| 3,642,332 | 2/1972 | Sinclair et al. . | |
| 3,825,991 | 7/1974 | Cornell . | |
| 3,893,672 | 7/1975 | Schonher . | |
| 3,989,257 | 11/1976 | Barr . | |
| 4,343,472 | 8/1982 | Hamilton . | |
| 4,447,183 | 5/1984 | Yunt . | |
| 4,635,941 | 1/1987 | Yoneyama . | |
| 4,754,977 | 7/1988 | Sahm . | |
| 4,809,983 | 3/1989 | Langert . | |
| 4,878,666 | 11/1989 | Hosoda . | |
| 4,944,515 | 7/1990 | Shearer . | |
| 5,013,041 | 5/1991 | Sun et al. . | |
| 5,050,879 | 9/1991 | Sun et al. . | |
| 5,199,707 | 4/1993 | Knox . | |
| 5,275,412 | 1/1994 | Innes . | |
| 5,301,941 | 4/1994 | Allen . | |
| 5,338,029 | 8/1994 | Falzone . | |
| 5,340,104 | 8/1994 | Griffin . | |
| 5,362,048 | 11/1994 | Haste . | |
| 5,382,019 | 1/1995 | Sneed . | |
| 5,407,196 | 4/1995 | Busnardo . | |
| 5,409,219 | 4/1995 | Saksun, Sr. . | |
| 5,433,444 | 7/1995 | Chiuminatta et al. . | |
| 5,451,048 | 9/1995 | Magamoto et al. . | |
| 5,511,779 | 4/1996 | Meyers . | |

FOREIGN PATENT DOCUMENTS

| | | |
|---|---|---|
| 854911 | of 0000 | Germany . |
| 2280380 | of 0000 | United Kingdom . |
| 9319815 | of 1993 | WIPO . |

*Primary Examiner*—Jeanette Chapman
*Assistant Examiner*—Stephen L. Blau
*Attorney, Agent, or Firm*—Emrich & Dithmar

[57] ABSTRACT

A golf club includes an elongated shaft and a head and coupling structure at an end of the shaft for joining it to the head. The coupling structure can include a flexing portion of reduced cross-sectional area for improved flexure or a thin strip member defining a unidirectional flexing portion which is resiliently flexible substantially only in a single plane. A shroud may surround the flexing portion to limit flexing thereof. The coupling structure may also include a pivot coupling for pivoting the head about the axis of the shaft or an axis parallel thereto. In another embodiment of the invention the coupling structure is connected to the head only at the rear thereof at the bottom and/or upper edge thereof intermediate the toe and heel and, in the case of a wood-type head, such coupling structure is disposed in a socket in the top of the head. The coupling structure may include any one or more of the flexing, pivoting and medial rear edge attachment features.

18 Claims, 8 Drawing Sheets

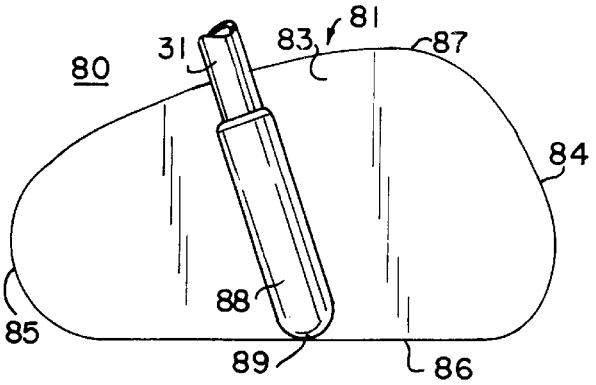
FIG. 11
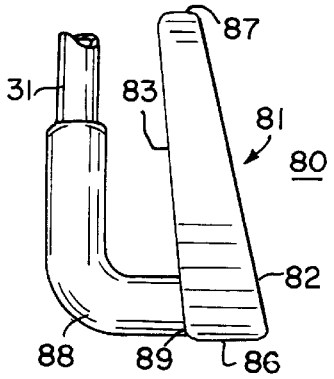
FIG. 12
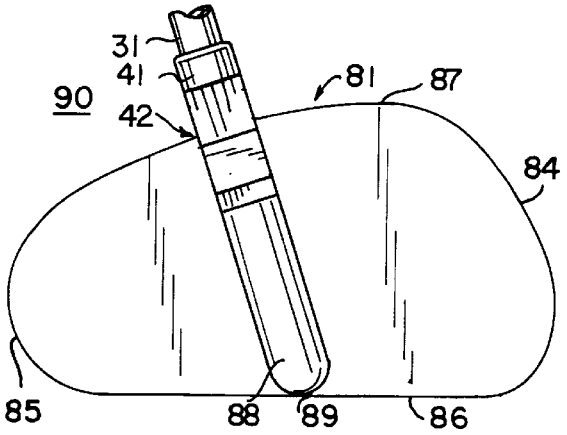
FIG. 13
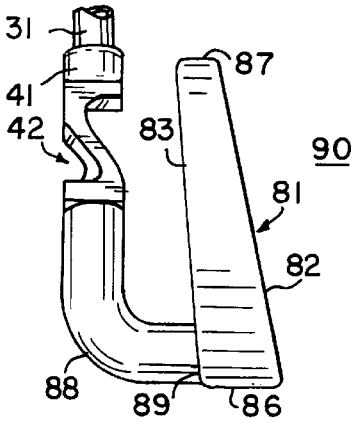
FIG. 14
FIG. 15
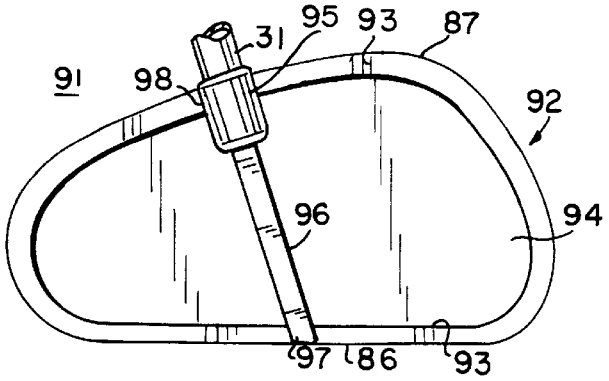
FIG. 16
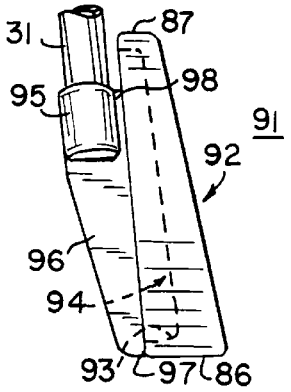

GOLF CLUB WITH IMPROVED COUPLING BETWEEN HEAD AND SHAFT

CROSS REFERENCE TO RELATED APPLICATION

This is a continuation-in-part of application Ser. No. 08/789,643, filed Jan. 27, 1997, now abandoned, which is, in turn, a continuation-in-part of application Ser. No. 08/615,525, filed Mar. 11, 1996, now abandoned.

BACKGROUND OF THE INVENTION

1. Field of the Invention

The invention relates to golf clubs of the wood type and iron type and, in particular, to such clubs which are designed to improve distance and accuracy.

2. Description of the Prior Art

Golf clubs are made in three distinct types or categories. One type is the putter, designed to roll the ball on the ground without causing the ball to take flight. The present invention relates to the remaining two types of club, which are designed to propel the ball through the air with various trajectories.

These types include "wood" types, in which the head was traditionally made of wood (although the head is now commonly made with metal shaped like conventional woods), and iron-types. Each of the wood and iron types of club has a head which includes a heel, a toe, a striking face, a sole or bottom flange portion which extends between the toe and heel, and a top or upper edge which also extends between the toe and heel. The head also includes a hosel, which is generally a socket or receptacle for receiving the club shaft and supporting the club on the end of the shaft. The striking face is generally inclined at an angle depending upon the required "loft" of the club. In general, the greater the loft the higher the trajectory of the shot and the lower the distance that the ball will travel, assuming that the ball is struck properly, so that contact with the ball is made with a particular portion of the striking face, commonly referred to as the "sweet spot".

While different clubs are designed to propel a ball different distances and with different trajectories, in general the golfer desires to maximize the distance that the ball can be hit with any given wood-type or iron-type club. The other fundamental concern of the golfer is control or accuracy, i.e., hitting the ball so that it travels in the desired direction. The typical golfer is most concerned with hitting the ball so that it follows a straight path to the target. In general, this requires that, at the time of impact, a line between the toe and heel of the club is substantially perpendicular to the intended direction of travel. If the striking face is tilted away from the golfer at the point of impact, the ball will tend to curve in that direction (i.e., to the right for a right-handed golfer), resulting in what is known as a "slice." If, on the other hand, the club face is tilted toward the golfer at the point of impact, the ball will curve in the opposite direction, resulting in a "hook." Many golfers have difficulty consistently hitting the ball straight and will, instead, have a natural tendency to either "slice" or "hook." Highly skilled golfers, on the other hand, can intentionally slice or hook the ball to curve it around obstacles on the golf course or cause the ball to approach an intended landing area from a particular direction.

Another problem faced by the typical golfer is to consistently strike the ball at the "sweet spot" of the club striking face. In the typical club the shaft is attached to the head at the heel. Thus, if the ball is struck at the heel of the club, this can result in what is known as a "shank" shot, causing the ball to have an unpredictable trajectory. If the ball is struck adjacent to the toe, i.e., the maximum distance from the shaft, the resulting moment arm can twist the shaft in the golfer's hands, also resulting in erratic shots.

Heretofore, attempts have been made to increase distance by constructing the golf club shaft of inherently more flexible or resilient materials, such as graphite. But such materials can be very expensive. Attempts at improving distance and control have also been made by weighting the club head in various manners to change the center of gravity and, thereby, the "sweet spot", so as to accommodate the needs of a particular golfer, such arrangements being disclosed, for example, in U.S. Pat. Nos. 5,013,041 and 4,754,977. However, this selective weighting technique requires maintaining a plurality of parts for the club head. Improved control has also been obtained by connecting the hosel to the club head substantially at the center of mass of the club head, such an arrangement being disclosed in U.S. Pat. No. 5,338,029. While this technique does tend to increase the likelihood of striking the ball at the "sweet spot" of club face, it is a technique which has been used with only iron-type clubs.

SUMMARY OF THE INVENTION

It is a general object of the invention to provide an improved golf club which avoids the disadvantages of prior golf clubs, while affording additional structural and operating advantages.

An important feature of the invention is the provision of a golf club of the wood or iron type which can increase the distance achievable with the club while still being of economical construction.

Another feature of the invention is the provision of a golf club of the type set forth which minimizes the chance of damage to the club in use.

A further feature of the invention is the provision of a golf club of the type set forth, which is user-adjustable to control the direction in which a ball travels when struck with a club head.

In connection with the foregoing feature, a further feature of the invention is the provision of a golf club of the type set forth, wherein the club head is selectively pivotable relative to the shaft.

A further feature of the invention is the provision of a golf club which provides coupling of the shaft to the head at locations on the head which improve control.

In connection with the foregoing features, a further feature of the invention is the provision of a golf club of the type set forth which includes different combinations of the foregoing features.

Certain ones of these and other features of the invention are attained by providing a golf club comprising: an elongated shaft having a longitudinal axis, a club head, and a coupling structure discrete from the head and the shaft and coupling the head to an end of the shaft, the coupling structure including an elongated axially extending continuous and imperforate flexing portion having along substantially its entire length a solid cross-sectional area which is substantially less than the cross-sectional area of the shaft.

Other features of the invention are attained by providing a club which limits flexural motion of the head relative to the shaft.

Further features of the invention are attained by providing a golf club including: an elongated shaft having a longitudinal axis, a club head, and a pivot coupling joining the head to an end of the shaft and accommodating pivotal movement of the head about a pivot axis coaxial with or parallel to the longitudinal axis of the shaft.

Still further features of the invention are attained by providing a golf club including: an elongated shaft; a head having a toe portion, a heel portion and upper and lower edge portions extending between the toe and heel portions, the head further having a forward striking wall including a striking side and a rear side; and a coupling structure connected to an end of the shaft and connected to the rear side of the striking wall at only at least one of the upper and lower edge portions at a location spaced substantially from the toe and heel portions.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 11 is a fragmentary rear elevational view of a golf club in accordance with another embodiment of the invention;

FIG. 12 is a fragmentary end elevational view of the golf club of FIG. 11, as viewed from the right-hand end thereof;

FIGS. 13 and 14 are, respectively, views similar to FIGS. 11 and 12 of another embodiment of the invention;

FIGS. 15 and 16 are, respectively, views similar to FIGS. 11 and 12 of a still further embodiment of the invention;

Figure 2:
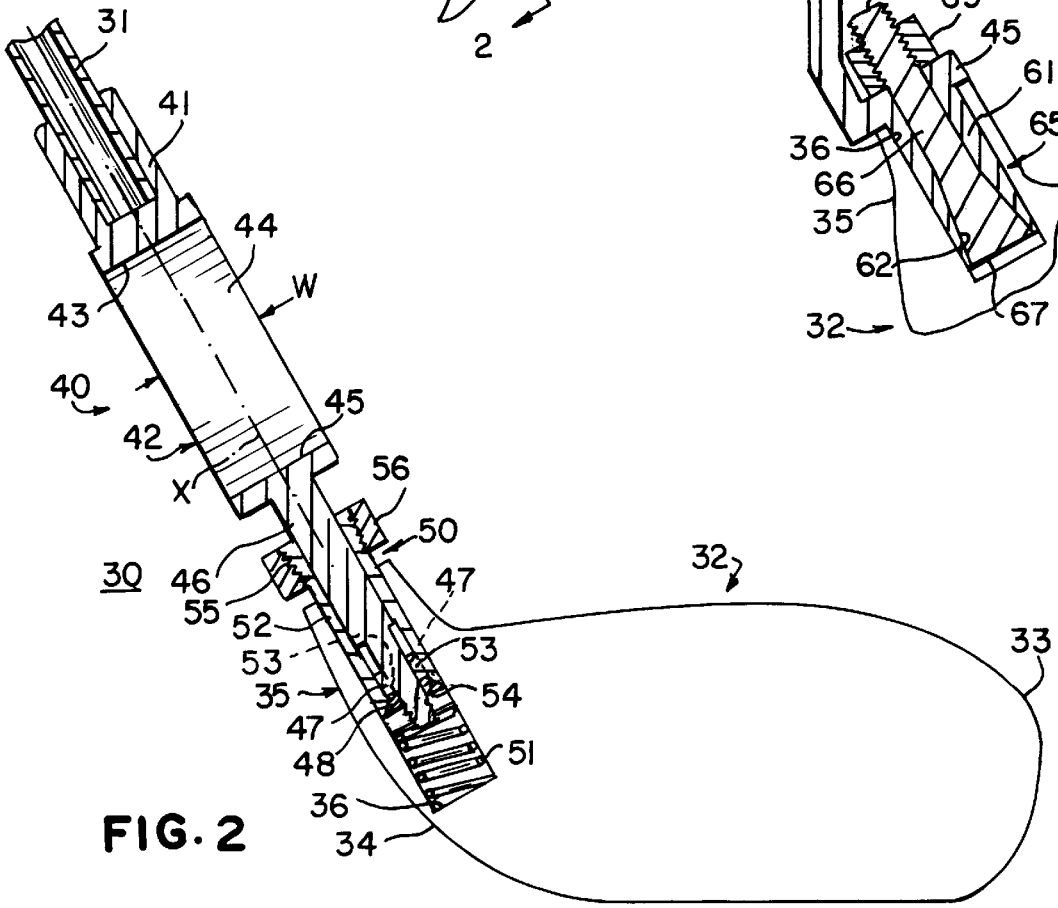
FIG. 2 is an enlarged, fragmentary, sectional view taken generally along the line 2—2 in FIG. 1.
Figure 23:
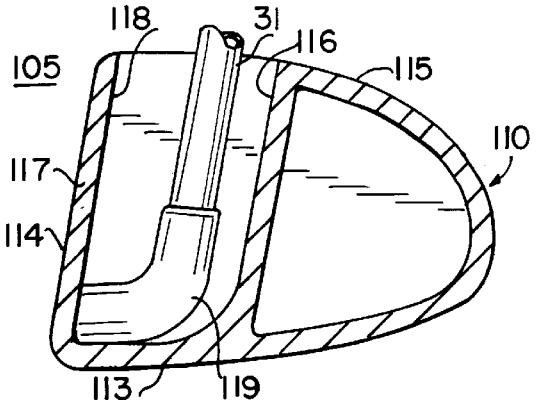
FIG. 23 is a fragmentary view in vertical section of a wood-type golf club in accordance with another embodiment of the invention.
Figure 24:
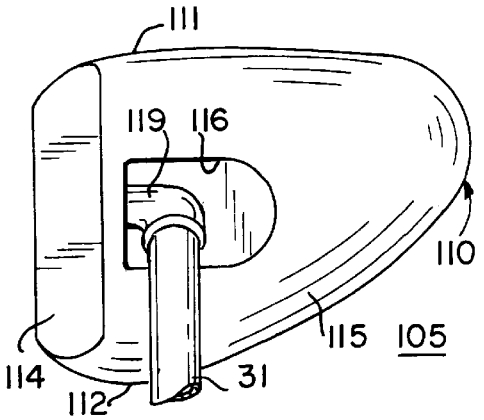
Figure 25:
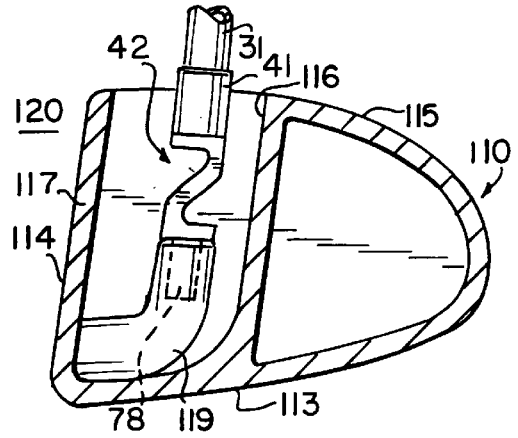
Figure 26:
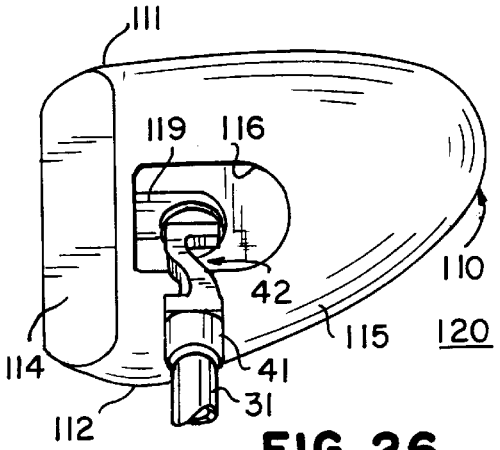
Figure 27:
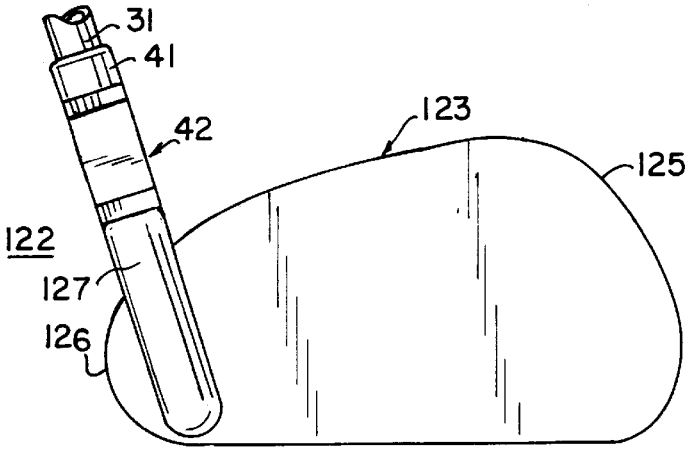
Figure 28:
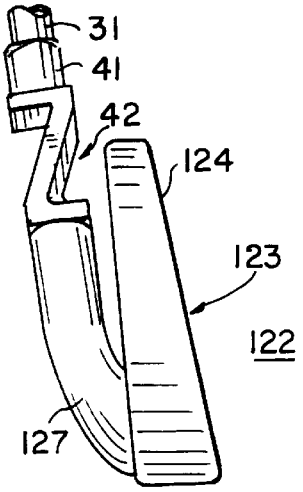
Figure 29:
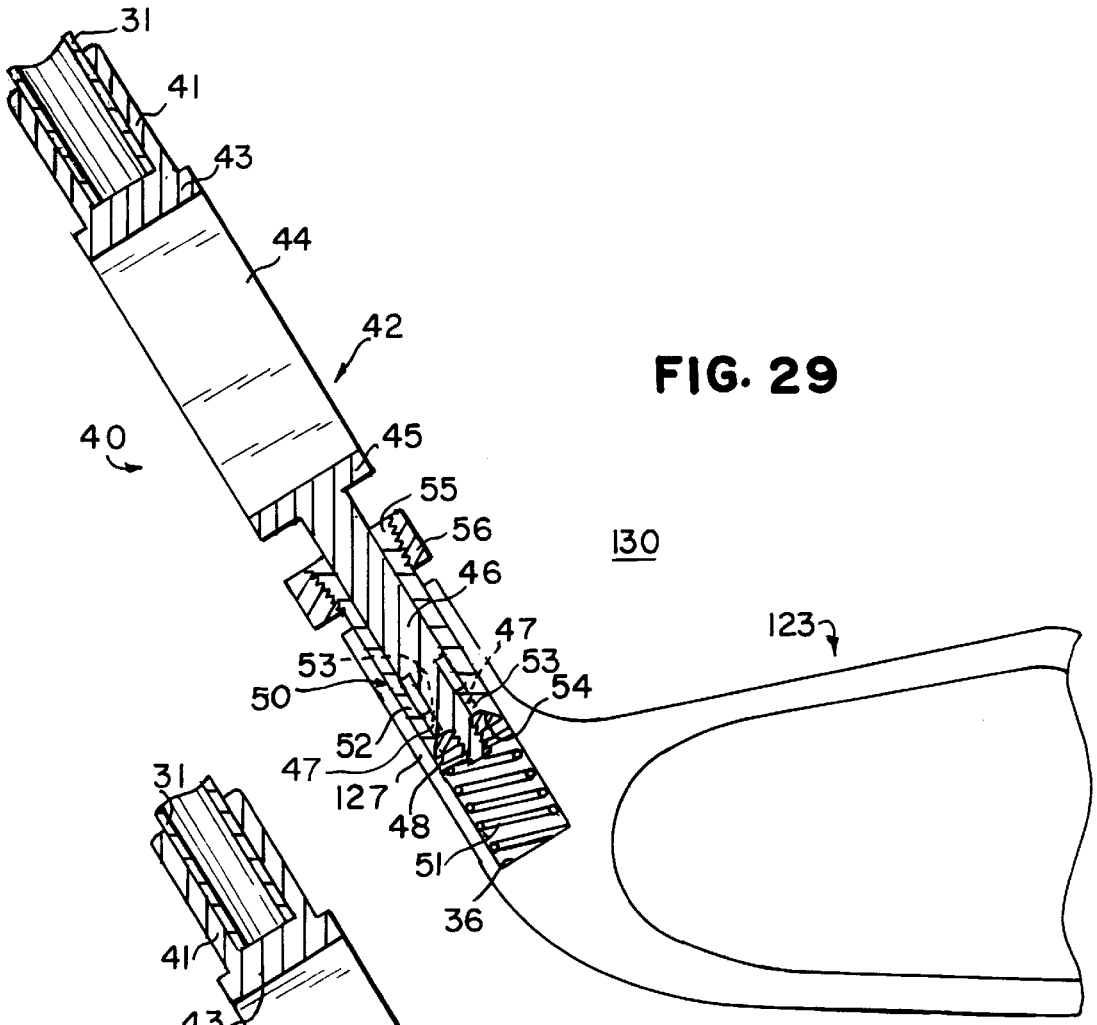
Figure 30:
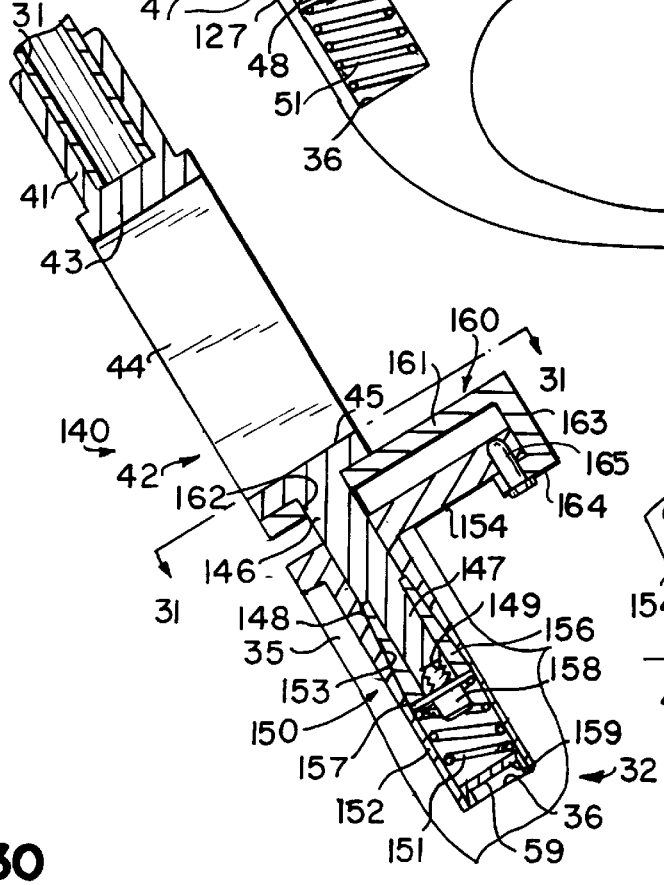
Figure 31:
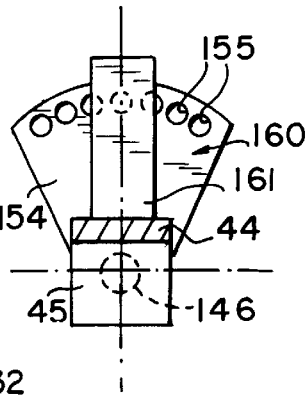
Figure 32:
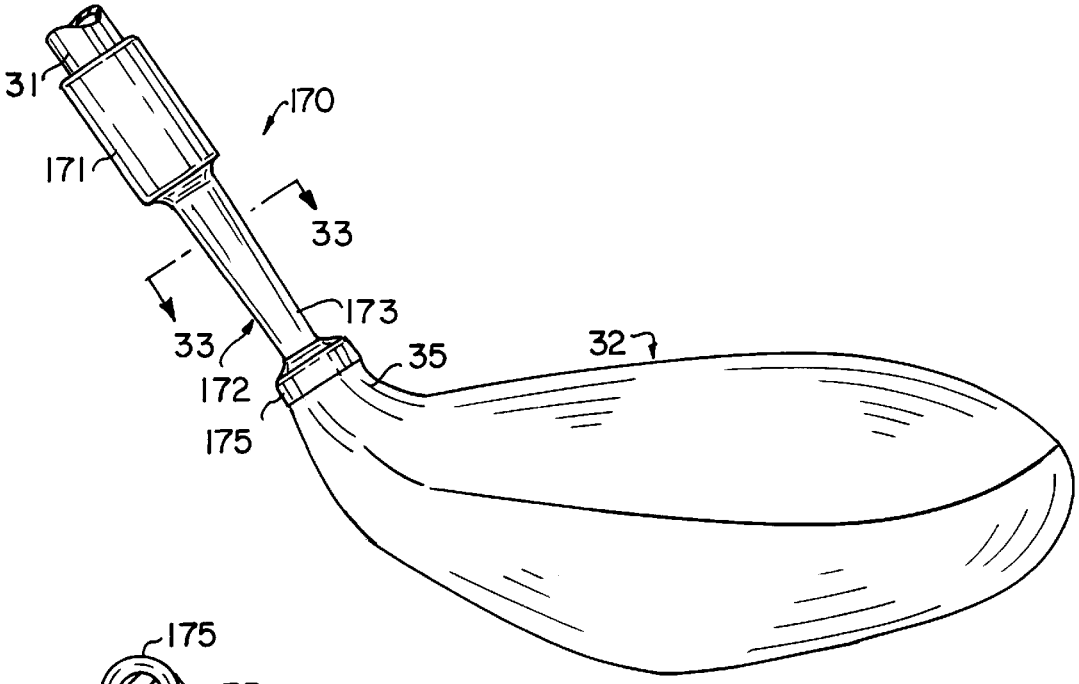
Figure 33:
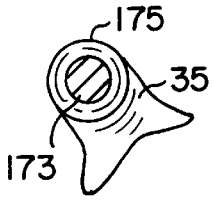
Figure 34:
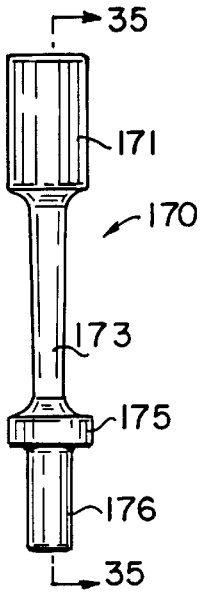
Figure 35:
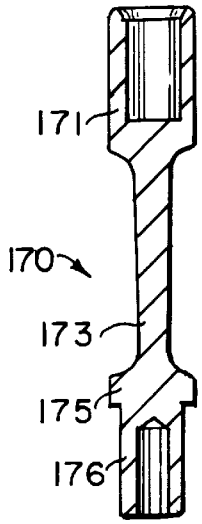
Figure 36:
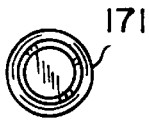
Figure 37:
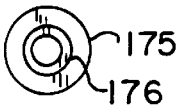
Figure 38:
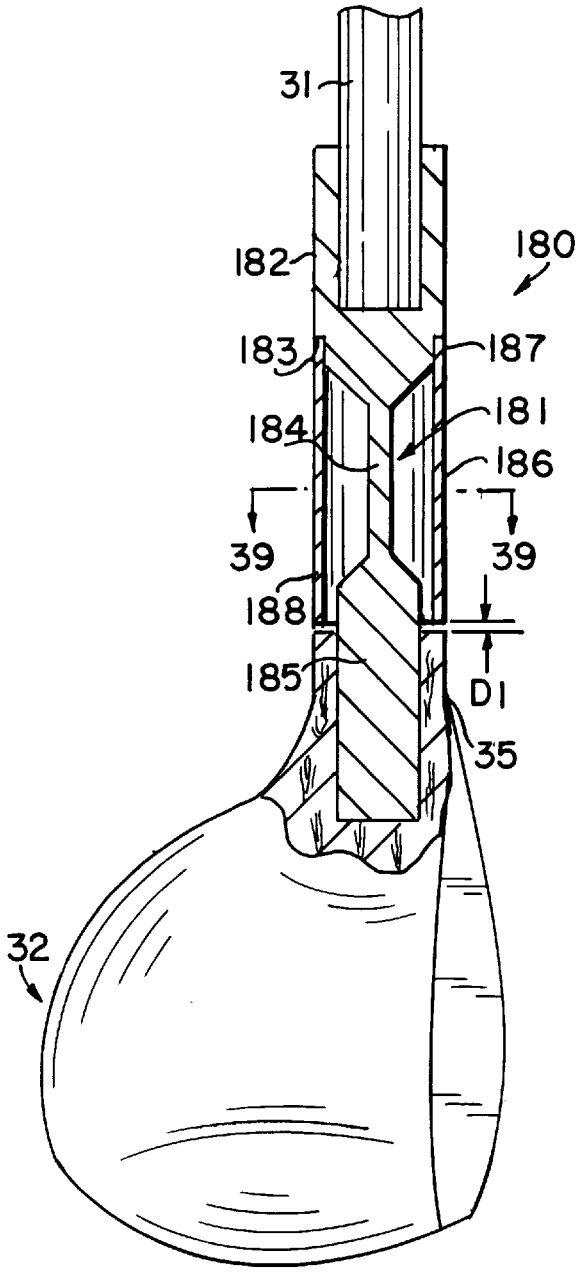
Figure 39:
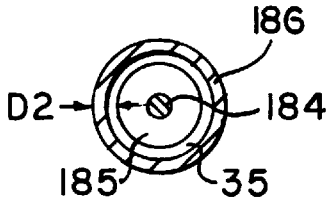

FIG; 24 is a fragmentary top plan view of the golf club of FIG. 23;

FIGS. 25 and 26 are, respectively, views similar to FIGS. 23 and 24 of another embodiment of the invention;

FIGS. 27 and 28 are, respectively, views similar to FIGS. 11 and 12 of a still further embodiment of the invention;

FIG. 29 is a view similar to FIG. 2, showing the coupling structure of FIG. 2 connected to an iron-type head;

FIG. 30 is a fragmentary view similar to FIG. 2, showing another embodiment of coupling structure in accordance with the present invention;

FIG. 31 is a sectional view taken generally along the line 31—31 in FIG. 30;

FIG. 32 is a fragmentary side elevational view of a coupling structure in accordance with another embodiment of the invention coupling a golf club shaft to a wood-type head;

FIG. 33 is a fragmentary sectional view taken along the line 33—33 in FIG. 32;

FIG. 34 is a side elevational view of the coupling structure of FIG. 32;

FIG. 35 is a view in vertical section taken along the line 35—35 in FIG. 34;

FIG. 36 is a top plan of the coupling structure of FIG. 34;

FIG. 37 is a bottom plan view of the coupling structure of FIG. 34;

FIG. 38 is a fragmentary, front elevational view, in partial section, of a coupling structure in accordance with another embodiment of the invention; and FIG. 39 is a sectional view taken along the line 39—39 in FIG. 38.

DESCRIPTION OF THE PREFERRED EMBODIMENTS

Figure 1:
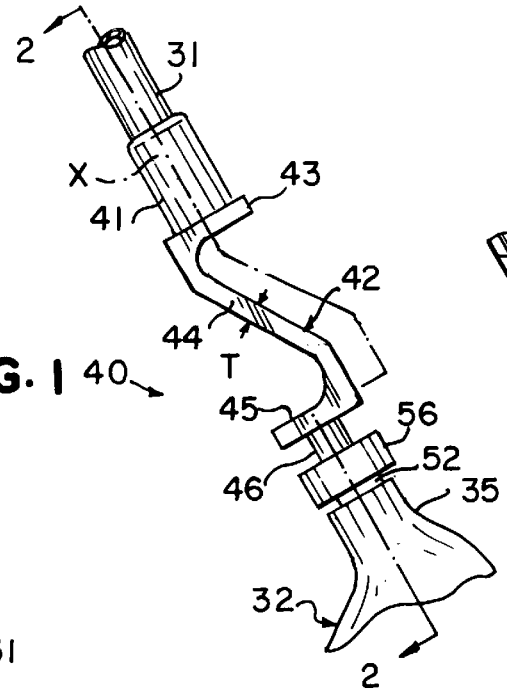
FIG. 1 is a fragmentary side elevational view of a coupling structure in accordance with a first embodiment of the present invention, coupling a golf club shaft to a wood-type head.

Referring to FIGS. 1 and 2, there is illustrated a golf club, generally designated by the numeral 30, having a shaft structure including an elongated shaft 31 and coupling structure 40. The shaft 31 has a longitudinal axis X, only the lower end of which shaft is illustrated, and which is coupled by the coupling structure to a head 32. The head 32 is illustrated as being of the wood type, but it will be appreciated that the principles of the invention would also be applicable to iron-type heads. The head 32 has a toe 33 and a heel 34, from which extends a hosel 35 defining a socket 36.

The coupling structure 40, constructed in accordance with a first embodiment of the present invention, is disposed at the lower end of the shaft 31. The coupling structure 40 includes a socket 41 for receiving the adjacent end of the shaft 31. Unitary with the socket 41 is a unidirectional flex member 42, which is generally in the nature of a thin metal strip or band having an attachment flange 43 unitary with the socket 41, an elongated flex portion 44 and an attachment flange 45 unitary with a depending pin 46, which is substantially coaxial with the socket 41. The unidirectional flex member 42 is generally Z-shaped in transverse cross section, with the attachment flanges 43 and 45 being substantially parallel to each other and perpendicular to the shaft axis X, and with the flex portion 44 defining a substantially flat, planar, inclined member extending from the forward end of the attachment flange 43 to the rear end of the attachment flange 45. The flex portion 44 has a width W and a thickness T, such that the thickness T is substantially less than the width W and extends substantially parallel to a predetermined plane (the plane of the paper in FIG. 1). Accordingly, the flex portion 44 will be relatively flexible in the direction of its thickness T, and will be substantially inflexible in other directions. Thus, the flex portion 44 will flex such that a point therein can move relative to other portions of the shaft structure substantially only parallel to a single plane, i.e., the plane of the paper in FIG. 1. As can be seen from FIGS. 1 and 2, preferably the unidirectional flex member 42 is oriented such that the width W extends in a direction substantially perpendicular to the direction of swing of the club 30.

The pin 46 is provided adjacent to its distal end with circumferentially arranged splines 47 and is integral at its distal end with a generally frustoconical tapered end piece 48, which may be fixed to the pin 46 by a suitable threaded coupling. The pin 46 forms a part of a pivot coupling 50, which also includes a helical compression spring 51 seated in the head socket 36, and a tubular sleeve 52 which is received in the socket 36 above the spring 51, being fixedly secured to the hosel 35 by suitable means, such as an appropriate adhesive. The sleeve 52 is also provided with radially inwardly extending splines 53 arranged for meshing engagement with the splines 47 of the pin 46. The sleeve 52 is also provided with an internal taper 54 at its lower end which is mateable with the tapered end piece 48 of the pin 46 to limit axial outward movement of the pin 46. The outer end of the sleeve 52 projects outwardly of the hosel 35 and is diametrically split, preferably into four sectors, the split portion having a tapered external surface having a tapered thread 55 formed thereon and disposed for engagement with a tapered nut 56.

In assembly, the spring 51 is inserted in the socket 36. Then the pin 46 is inserted through the sleeve 52, and the tapered end piece 48 is fixed to the end of the pin 46 and the nut 56 is fitted over the sleeve 52 for engagement with the thread 55. Then, the sleeve 52 is inserted into the socket 36 and fixed in place therein.

In operation, it will be appreciated that the pivot coupling 50 accommodates pivotal movement of the head 32 about the axis X of the shaft 31, thereby permitting the inclination of the striking face relative to the direction of swing to be selectively changed by the user without changing the attitude of the shaft 31. Thus, the head can be left in a standard mid-line orientation to produce a straight shot, or can be rotated in one direction to open the face to produce a slice, or rotated in the opposite direction to close the face and produce a hook.

Normally, the nut 56 is threaded firmly into engagement with the thread 55 to compress the split end of the sleeve 52 radially inwardly against the pin 46 to lock the pin 46 and the head 32 against relative axial movement. When it is desired to rotate the head 32, the nut 56 is loosened and then the head 32 is pushed upwardly along the pin 46 until the splines of the pin 46 are disengaged from those of the sleeve 52. Then the head is rotated the desired amount and released, so that the pin 46 is withdrawn back up into the sleeve 52 under the urging of the spring 51, reengaging the splines. It will be appreciated that the engagement of the tapered end piece 48 with the internal taper 54 of the sleeve 52 limits axial outward movement of the pin 46 relative to the sleeve 52. When the head is positioned at the desired angle, the nut 56 is retightened to lock it in place.

In use, it will be appreciated that, when the club 30 is swung, the unidirectional flex member 42 will act somewhat like a wrist, flexing in the direction of swing to add an additional "whip" action to the club head 32, tending to increase its velocity at impact, thereby increasing the force imparted to the ball, resulting in greater distance. Because of its unidirectional flexing nature, the flex portion 44 will add velocity only in the direction of the swing and, therefore, will not adversely affect control of the shot.

Figure 3:
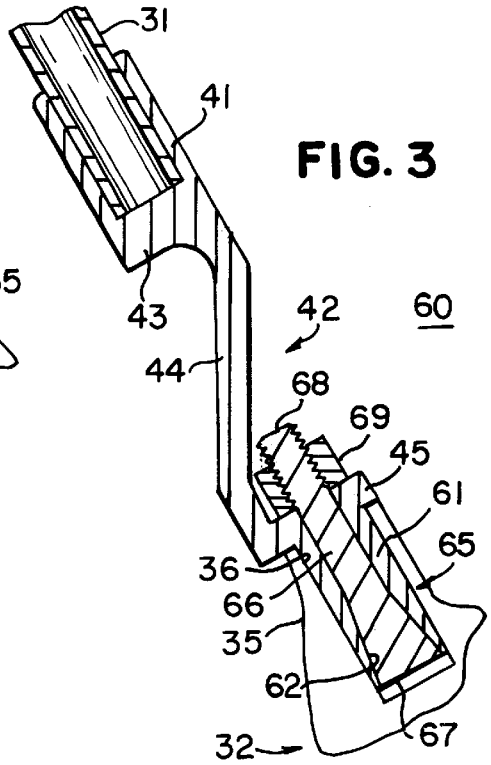
FIG. 3 is a fragmentary sectional view of a golf club coupling structure in accordance with a second embodiment of the invention.

Referring now to FIG. 3, there is illustrated a coupling structure 60 in accordance with another embodiment of the invention, which can be substituted for the coupling structure 40 of FIGS. 1 and 2 to provide continuous adjustment of the angle of the head 32. Much of the coupling structure 60 is identical to the coupling structure 40 and like parts have like reference numbers. In the coupling structure 60, the attachment flange 45 of the unidirectional flex member 42 is unitary with a depending sleeve 61 which fits into the head socket 36, the inner end of the sleeve 61 having an internal taper 62. The sleeve 61 forms part of a pivot coupling 65, which also includes a pin 66 which is received coaxially through the sleeve 61 and has a frustoconical tapered end 67 matingly engageable with the internal taper 62 of the sleeve 61. The pin 66 has an externally threaded outer end 68 which is threadedly engageable with a nut 69. It will be appreciated that when the nut 69 is screwed down against the attachment flange 45, it draws the pin 66 outwardly, wedging the tapered end 67 into firm engagement with the internal taper 62 for locking the parts against relative rotation. When it is desired to adjust the rotational position of the head 32, the nut 69 is loosened, permitting the tapered end 67 of the pin 66 to disengage from the sleeve 61 to accommodate relative rotational movement.

While each of the coupling structures 40 and 60 includes both a unidirectional flex member 42 and a pivot coupling 50 or 65, it will be appreciated that these two parts could also be used separately. Thus, the coupling structure 40 or 60 could dispense with the pivot coupling 50 or 65, in which case the pin 46 or 66 could be shaped or dimensioned to be fixed directly in the head socket 36. Alternatively, the flex portion 42 could be dispensed with, in which case the shaft socket 41 could be formed unitary with the attachment flange 45.

Figure 4:
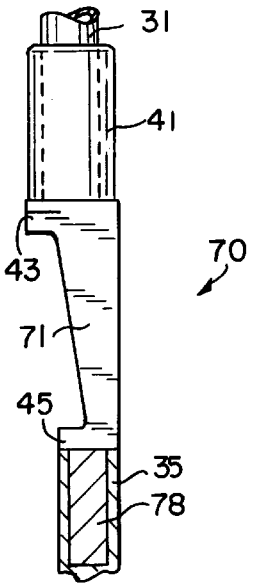
FIGS. 4–10 are fragmentary side elevational views of other embodiments of coupling structures of the present invention which include a unidirectional flexing portion.

Referring now to FIGS. 4–10, there are illustrated a number of different coupling structures incorporating only a unidirectional flex member, but no pivot coupling. Portions of these coupling structures which are substantially identical to the coupling structure 40, described above, bear the same reference numerals. In FIG. 4, there is shown a coupling structure 70 having a wedge-shaped flex portion 71, which is thicker at its upper end than at its lower end and is connected to corresponding ends of the attachment flanges 43 and 45. Preferably, the attachment flange 45 is unitary with a depending pin 78, which is receivable in the hosel 35.

Figure 5:
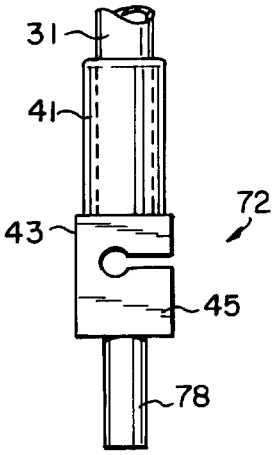
Figure 6:
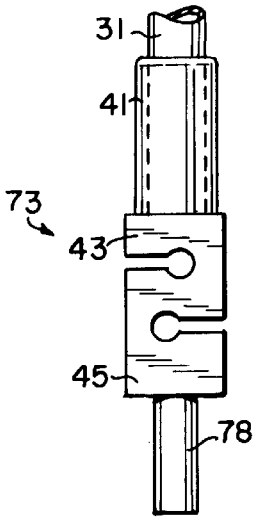
Figure 7:
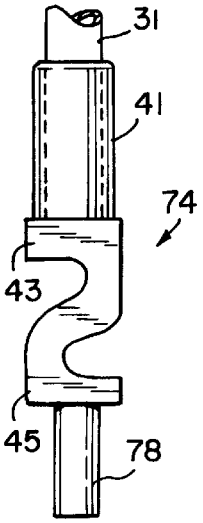
Figure 8:
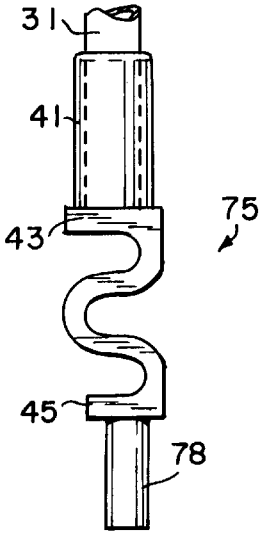
Figure 9:
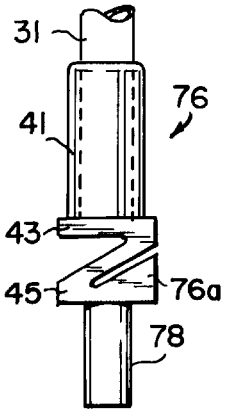
Figure 10:
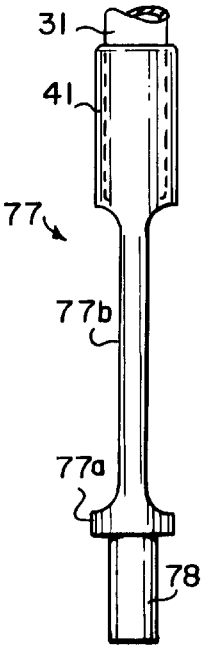

FIG. 5 depicts a coupling structure 72 in which the attachment flanges 43 and 45 are joined at one end thereof by a short member which cooperates therewith to define a generally C-shaped flex portion. FIG. 6 depicts a unidirectional flex member 73 which has a generally square S-shaped flexible portion. FIG. 7 depicts a similar unidirectional flex member 74, in which the S-shaped flex portion is more rounded. FIG. 8 depicts a unidirectional flex member 75 with a double S-shaped flex portion. FIG. 9 depicts a unidirectional flex member 76 which is generally Z-shaped and very similar to the flex member 42, described above, except that the lower attachment flange **76*a* has an inclined upper surface. FIG. 10 depicts a unidirectional flex member 77 which is similar to the unidirectional flex member 70 of FIG. 4, described above, except that there are no attachment flanges 43 and 45. Rather, the socket 41 is formed in one end of a longer cylindrical body 77*a* which has recesses formed in diametrically opposite sides thereof to define a thin, flat flex portion 77*b*** with parallel flat sides. It will be appreciated that other configurations of unidirectional flex member would also be possible.

Referring now to FIGS. 11 and 12, there is illustrated a golf club 80 having an iron-type head 81 which defines a blade or wall having a front striking face 82 and a rear side 83. The club head 81 also has a toe 84 and a heel 85, as well as a sole or lower edge 86 and an upper edge 87, both of which extend between the toe 84 and the heel 85. The head 81 is provided with a generally L-shaped hosel 88 which is fixed to the head 81 at a connection point 89 disposed along the rear side 83 at the sole 86, approximately midway between the toe 84 and the heel 85. The upper end of the hosel 88 defines a standard socket for the club shaft 31. The attachment of the hosel 88 at a location which is generally in vertical alignment with the "sweet spot" of the head will enhance the chances of striking the ball at the "sweet spot", rather than at the toe or the heel. Also, since most iron-type heads are perimeter weighted, the attachment of the hosel 88 at the perimeter provides connection at a strengthened part of the head.

FIGS. 13 and 14 depict a golf club 90 in which the club head 81 of FIGS. 11 and 12 is combined with a coupling structure incorporating the unidirectional flex member 42 of FIG. 1 interposed between the hosel 88 and the shaft 31.

FIG. 15 discloses a golf club 91 having an iron-type head 92 with a rearwardly extending flange 93 around its entire perimeter which defines a hollow or cavity 94 at the rear side of the head. The club 90 has a hosel 95 adapted for socketing the associated shaft 31 and unitary with a coupling arm 96, which is a generally flat, blade-like member fixedly secured to the head 92 at connection points 97 and 98, respectively disposed along the sole 86 and the upper edge 87 approximately midway between the toe and heel. This blade-like coupling arm 96 permits attachment to the relatively thin flange 93 without obstructing the hollow or cavity 94, as would be necessary if the full cylindrical diameter of the upper end of the hosel 95 were extended to the attachment points.

Figure 17:
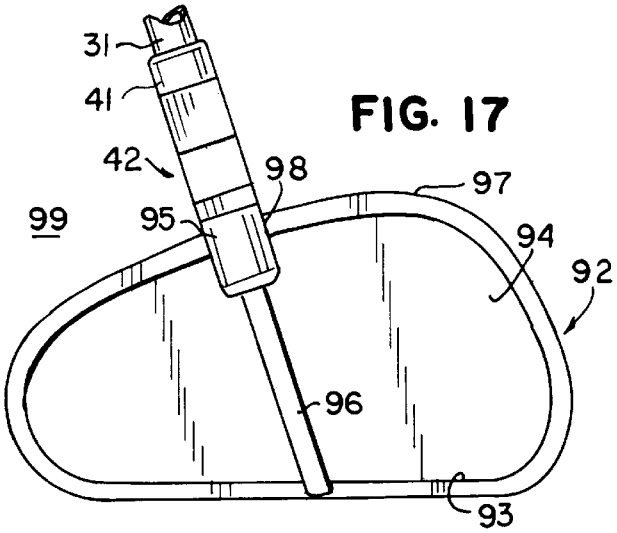
FIGS. 17 and 18 are, respectively, views similar to FIGS. 11 and 12 of yet another embodiment of the invention.
Figure 18:
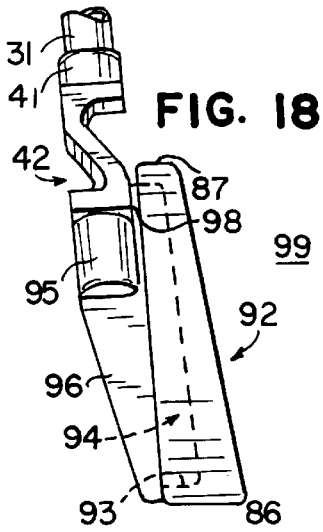

FIGS. 17 and 18 disclose a golf club 99 combining the head 92 of FIGS. 15 and 16 with the unidirectional flex member 42 of FIG. 1, interposed between the hosel 95 and the shaft 31.

Figure 19:
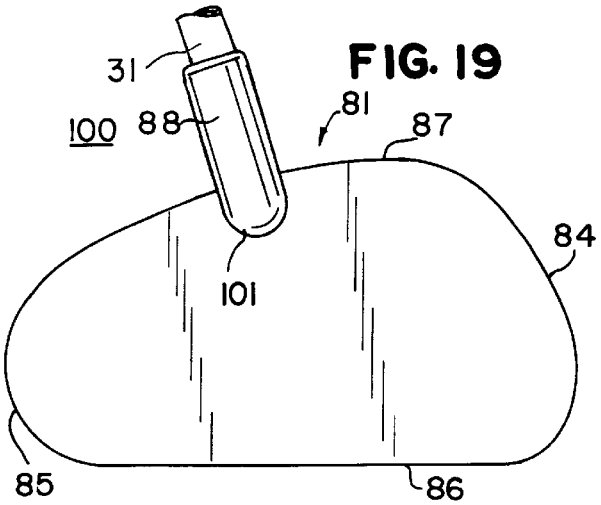
FIGS. 19 and 20 are, respectively, views similar to FIGS. 11 and 12 of yet another embodiment of the invention.
Figure 20:
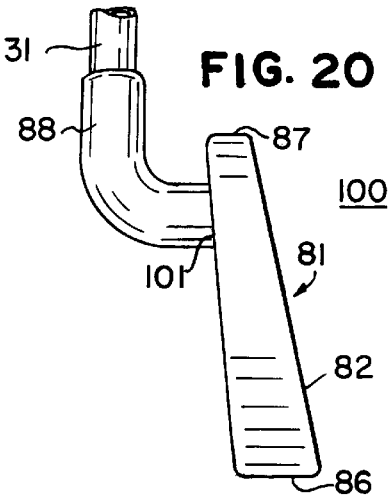

FIGS. 19 and 20 depict a golf club 100 which is substantially the same as the golf club 80 of FIGS. 11 and 12, except that the hosel 88 is connected to the head 81 at a connection point 101 along the upper edge 87 approximately midway between the toe and the heel.

Figure 21:
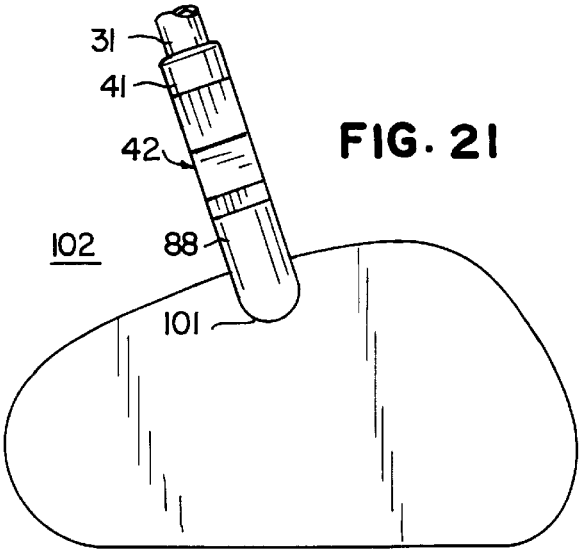
FIGS. 21 and 22 are, respectively, views similar to FIGS. 11 and 12 of still another embodiment of the invention.
Figure 22:
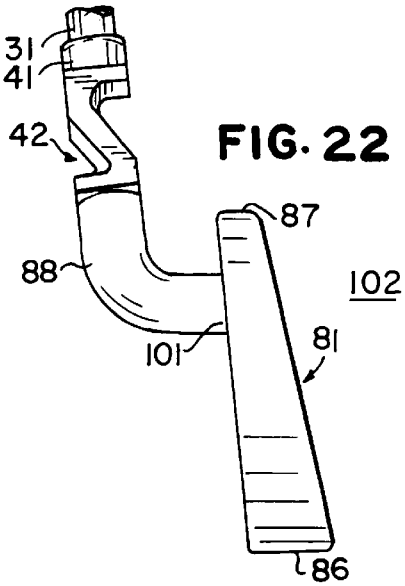

FIGS. 21 and 22 depict a golf club 102 which combines the head of FIGS. 19 and 20 with the unidirectional flex member 42 of FIG. 1.

FIGS. 23 and 24 depict a golf club 105 with a wood-type head 110 having a toe 111, a heel 112, a sole 113, a striking face 114 and a top 115. A socket or cavity 116 is formed in the top 115 just rearwardly of the striking face 114 and approximately midway between the toe 111 and the heel 112 and extends substantially to the sole 113, the socket 116 cooperating with the striking face 114 to define a wall 117 therebetween having a rear or socket side 118. A generally L-shaped hosel 119 is fixedly secured to the rear side 118 of the wall 117 at the sole 113 and is adapted to socket the club shaft 31 in a known manner. Thus, it will be appreciated that the golf club 105 incorporates the perimeter attachment feature of the embodiments of FIGS. 11–22 in a wood-type head for providing the same advantages.

FIGS. 25 and 26 depict a golf club 120 in which the head 110 of FIGS. 23 and 24 is combined with the unidirectional flex member 42 of FIG. 1.

FIGS. 27 and 28 illustrate a golf club 122 in which the unidirectional flex member 42 of FIG. 1 is incorporated in an iron-type head 123 of standard configuration, having a front striking face 124, a toe 125 and a heel 126, as well as a hosel 127 which is connected at the heel 126 and is offset slightly forwardly therefrom.

It will be appreciated that either of the pivot couplings 50 or 65 could be incorporated in any of the golf clubs of FIGS. 11–28. A golf club 130 effecting such a combination is illustrated in FIG. 29, in which the coupling structure 40 of FIGS. 1 and 2 is coupled to the iron-type head 123 of FIGS. 27 and 28. Also, while the golf clubs of FIGS. 13, 14, 17, 18, 21, 22 and 25–29 have been illustrated utilizing the unidirectional flex member 42 of FIG. 1, it will be appreciated that any of the other flex members 70–77 of FIGS. 4–10 could also be utilized.

Referring now to FIGS. 30 and 31, there is illustrated a coupling structure, generally designated by the numeral 140, which is similar to the coupling structure 40 described above in connection with FIG. 2, except that it utilizes a different type of pivot coupling. Accordingly, portions of the coupling structure 140 which are the same as corresponding portions in the coupling structure 40 have the same reference numerals. In the coupling structure 140 the attachment flange 45 is unitary with a depending pin 146 which is substantially coaxial with the socket 41 and has a reduced-diameter end 147 forming an annular shoulder 148. Formed in the distal end face of the reduced-diameter end 147 is an internally threaded bore 149.

The pin 146 forms part of a pivot coupling 150, which also includes a helical compression spring 151 seated in the head socket 36, and a tubular sleeve 152 which is received in the socket 36 above spring 151, being fixedly secured to the hosel 35 by suitable means, such as an appropriate adhesive. The sleeve 152 has an upwardly narrowing frustoconical inner surface portion 153 intermediate its ends, and is provided at its upper end with a laterally outwardly extending, generally wedge-shaped flange 154 provided with a plurality of holes 155 therethrough adjacent to its distal end. A bushing 156 is received over the reduced-diameter end 147 of the pin 146 and is seated against the shoulder 148, the bushing 156 having a frustoconical outer surface shaped and dimensioned to mate with the frustoconical inner surface portion 153 of the sleeve 152. The bushing 156 has a length such that, when it is seated against the shoulder 148, its outer end surface is substantially coplanar with that of the pin 146. A washer 157 is received against these end surfaces and is held in place by a screw 158 threaded into the bore 149 in the pin 146. The bushing 156 is preferably heat shrunk onto the pin 146, but the washer 157 serves as an added insurance to retain it in place, as well as providing a bearing surface for the upper end of the spring 151. The lower end of the sleeve 152 is closed by a generally cup-shaped cap 159 which is seated just inside the end of the sleeve 151 and is secured in place by any suitable means. The cap 159 serves as a bearing surface for the spring 151 and also serves to seal the lower end of the sleeve 152 to prevent the entry of adhesive when the sleeve 152 is secured in place in the head socket 36.

The pivot coupling 150 also includes an index member 160 which has an elongated, generally rectangular arm 161 provided with a hole 162 therethrough adjacent to one end thereof for receiving the pin 146 therethrough. The arm 161 is unitary at its outer end with a depending flange 163 which is, in turn, unitary at its lower end with an inwardly extending foot 164. A pin 165 is fixedly secured by suitable means in a complementary opening through the foot 164 and projects upwardly therebeyond for reception in a selected one of the holes 155 in the flange 154, as will be explained more fully below.

In assembly, the index member 160 is first fixed onto the pin 146 against the attachment flange 45 by any suitable means, such as welding, brazing or the like. Then the sleeve 152 is fitted over the pin 156 until the flange 154 is against the arm 161, then the arm 154 is swung into place above the foot 164 and then lowered to receive the pin 165 through the central one of the holes 155. The remainder of the pivot coupling 150 is then assembled. The bushing 156 is received into the sleeve 152 and over the reduced-diameter end 147 of the pin 146 and heat shrunk in place, then the washer 157 and screw 158 are assembled, the spring is fitted inside the sleeve and the cap 159 is secured in place. Then the sleeve 152 is inserted into the head socket 36 and bonded in place.

In operation, it will be appreciated that, when it is desired to change the orientation of the head 32 relative to the shaft 31, the shaft 31 is pushed down against the head 32, depressing the pin 146 into the sleeve 152 against the urging of the spring 151, thereby disengaging the flange 154 from the pin 165. The shaft 31 is then rotated the desired amount and released to allow the pin 165 to recede into another hole 155 on the flange 154 onto the urging of the spring 151. The wedging action between the bushing 156 and the frustoconical inner surface portion 153 of the sleeve 152 will also serve to inhibit further rotation of the parts after they have been seated in an indexed position and also cooperates with the foot 164 to limit axial outward movement of the pin 146. It will be appreciated that by the use of this coupling structure 140, the user can visually see the rotational position selected. In this regard, it will be appreciated that, if desired, appropriate indicia could be placed on the flange 154 adjacent to the holes 155.

Referring now to FIGS. 32–37, there is illustrated another embodiment of coupling structure in accordance with the present invention, generally designated by the numeral 170, which is disposed at the lower end of the shaft 31 for coupling to an associated club head which, for purposes of illustration, is shown as a wood-type head 32, although it will be appreciated that an iron-type head could also be provided. The coupling structure 170 is preferably of unitary, one-piece construction, including a cylindrical socket 171 for receiving the adjacent end of the shaft 31. Unitary with the socket 171 is an elongated, axially extending flex portion 172, unitary at its lower end with a circular attachment flange 175 which is, in turn, unitary with a hollow, reduced-diameter coupling pin 176, adapted to be received in an associated socket in the hosel 35 of the club head 32. The flex portion 172 has a cross-sectional area which is substantially less than that of other portions of the shaft 31, and preferably has the same cross-sectional shape along its entire length. In the preferred embodiment, the flex portion 172 is in the nature of a solid rod 173 of circular transverse cross section. In the preferred embodiment the rod 173 tapers slightly from the socket 171 to the flange 175, but it could have the same cross-sectional area along substantially its entire length. Because of the substantially reduced cross section of the rod 173, it has a relatively greater flexibility than other portions of the shaft 31, serving to add additional "whip" action to the club head 32, tending to increase its velocity at impact in the same manner as was described above in connection with the coupling structures of FIGS. 1–10. The basic difference is that the coupling structure 170 does not preferentially flex in any one direction. While a the flex portion 172 is shown as a rod 173 of circular cross section in the preferred embodiment, it will be appreciated that other cross-sectional shapes could be used, as long as they do not preferentially flex in any one direction.

It will be appreciated that, to the extent that the several coupling structures described above are discrete from the associated club head and shaft, they can be replaceable so as to facilitate customization for individual golfers or individual clubs. Thus, the coupling structures may be designed with varying degrees of stiffness in the flex portion to accommodate golfers of various sizes and strengths who can generate different club speeds. Also, since the flex portion typically has a reduced cross-sectional area relative to other portions of the club and is designed to undergo greater flexure in use than other portions of the club, it is more susceptible to damage and breakage as a result of fatigue or misuse, such as by swinging the club head into the ground or the like. Also, it is possible that a coupling structure designed for one golfer might be overstressed if used by a larger or stronger golfer.

Referring now to FIGS. 38 and 39, there is illustrated another embodiment of coupling structure in accordance with the present invention, generally designated by the numeral 180, which is designed to alleviate some of the potential problems described above. The coupling structure 180 is disposed at the lower end of the shaft 31 for coupling to an associated club head which, for purposes of illustration, is shown as a wood-type head 32, although it will be appreciated that an iron-type head could also be provided.

The coupling structure 180 includes an inner member 181, which is preferably of unitary one-piece construction, and may be similar to the coupling structure 170 described above. The inner member 181 includes a shaft end defining a cylindrical socket 182 for receiving the adjacent end of the shaft 31. Formed in the outer surface of the socket 182 adjacent to its lower end is an annular shoulder 183. Unitary with the socket 182 is an elongated, axially extending flex portion 184, unitary at its lower end with a cylindrical coupling pin 185 which forms a head end of the coupling structure adapted to be received in an associated socket in the hosel 35 of the club head 32. The flex portion 184 preferably has a cross-sectional area which is substantially less than that of the shaft 31, and preferably has the same cross-sectional shape along its entire length. In the preferred embodiment, the flex portion 184 is in the nature of a solid rod of circular transverse cross section. While the rod is shown as having the same diameter along its entire length, it will be appreciated that it could be tapered in the manner of the rod 173, described above in connection with FIGS. 32–37. The inner member 181 functions in substantially the same manner described above in connection with the coupling structure 170.

However, the coupling structure 180 also includes a stop shroud 186 in the nature of a hollow, circularly cylindrical tube which has an attachment end 187 fitted against the annular shoulder 183 and fixed to the socket 182 thereat by any suitable means. Preferably the shroud 186 has an outer diameter substantially the same as that of the socket 182. The shroud 186 also has a free end 188 which terminates a predetermined distance D1 from the end of the hosel 35. The coupling pin 185 has an outer diameter less than the inner diameter of the shroud 186, so that the free end 188 of the shroud 186 is spaced from the coupling pin 185 by a clearance distance D2 which is shown around its entire circumference, although there need only be clearance along the front half of the circumference. The stop shroud 186 is formed of a suitably strong and rigid material, such as a suitable steel or other suitable metal.

In use, when the club is swung, the flex portion 184 will flex, in substantially the same manner described above in connection with the coupling structure 170, permitting lateral displacement of the head 32 relative to the shaft 31 so as to provide the "whip" action described above. However, in this case, the coupling pin 185 is engageable with the free end 188 of the stop shroud 186 to limit the lateral displacement of the head 32 and the head end of the coupling structure 180. It will be appreciated that this limits wear on the coupling structure 180, tending to increase its useful life, and prevents overflexing which might result in breakage of or damage to the inner member 181. It will also be appreciated that the clearance distance D2 may vary with the construction of the flex portion 184, which may be customized for particular golfers or for particular clubs, so as to permit a greater or lesser degree of flexure, depending upon the application.

While, for purposes of illustration, the stop shroud 186 has been shown used with a coupling structure similar to the coupling structure 170, which does not preferentially flex in any one direction, it could also be used with any of the coupling structures described above in FIGS. 1–31. In this regard, it will be appreciated that the stop shroud 186 could be designed to be engageable by a portion of the coupling structure or by a portion of the club head to which it is attached.

From the foregoing, it can be seen that there has been provided an improved golf club with a flex portion to provide increased distance, a stop shroud to limit flexural displacement of the head, a pivot coupling to accommodate pivoting of the head relative to the shaft and a coupling of the shaft to the head at locations along the perimeter of the head approximately midway between the toe and the heel for improved control and accuracy.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A golf club comprising: an elongated shaft having a longitudinal axis, a club head, and a coupling structure discrete from said head and said shaft and coupling said head to an end of said shaft, said coupling structure including an elongated axially extending continuous and imperforate flexing portion having along substantially its entire length a solid cross-sectional area which is substantially less than the cross-sectional area of the shaft, and further comprising a stop portion on said coupling structure spaced from said flexing portion and engageable therewith for limiting the flexural movement thereof.

2. The golf club of claim 1, wherein said flexing portion has the same cross-sectional shape along substantially its entire length.

3. The golf club of claim 2, wherein said flexing portion is circular in transverse cross-sectional shape.

4. The golf club of claim 1, wherein the cross-sectional area of said flexing portion tapers from a maximum value adjacent to the shaft to a minimum value adjacent to the head.

5. The golf club of claim 1, wherein said flexing portion is shaped and dimensioned for unidirectional flexing.

6. The golf club of claim 5, wherein said flexing portion includes a thin strip member having a width extending substantially perpendicular to said plane and a thickness extending substantially parallel to a plane, wherein said thickness is substantially less than said width.

7. A golf club including: an elongated shaft having a longitudinal axis, a club head, and a pivot coupling joining said head to an end of said shaft and accommodating pivotal movement of said head about a pivot axis coaxial with or parallel to the longitudinal axis of the shaft, said pivot coupling including lock mechanism for preventing movement of said head relative to said shaft, said pivot coupling including a sleeve member and a pin member coaxially received in said sleeve member for axial and rotational movement relative thereto, said sleeve member and said pin member having mating tapered portions engageable for limiting relative axial movement in one direction, said lock mechanism including a split tapered portion on said sleeve member and a tapered nut engageable with said split tapered portion for wedging said split tapered portion radially into firm gripping engagement with said pin member.

8. The golf club of claim 7, wherein said pivot coupling includes an indicator mechanism visible to the user for indicating the rotational position of the head relative to the shaft.

9. A golf club including: an elongated shaft; a wood-type head having a toe portion, a heel portion, and a top surface and upper and lower edge portions extending between said toe and heel portions, said head further having a forward striking wall including a striking side and a rear side, said top surface having a socket formed therein to define the rear side of the striking wall; and a coupling structure connected to an end of said shaft and disposed in the socket and connected to the rear side of said striking wall at only at least one of said upper and lower edge portions at a location spaced substantially from said toe and heel portions.

10. The golf club of claim 9, wherein said coupling structure is connected to said head only at one of said lower edge portion and said upper edge portion.

11. The golf club of claim 10, wherein said coupling structure is connected to said head at the lower edge portion.

12. The golf club of claim 9, wherein said coupling structure further includes an elongated axially extending flexing portion having along substantially its entire length a cross-sectional area which is substantially less than the cross-sectional area of the shaft.

13. The golf club of claim 9, wherein said shaft has a longitudinal axis, said coupling structure including a pivot coupling accommodating pivotal movement of said head about a pivot axis coaxial with or parallel to the longitudinal axis of the shaft.

14. A golf club comprising:

an elongated shaft having a longitudinal axis, a club head, and a coupling structure having a shaft end coupled to the shaft and a head end coupled to the head, said coupling structure including an elongated axially extending flexing portion disposed between the shaft end and the head end and shaped and dimensioned to flex to a greater degree than the shaft to accommodate lateral flexing movement of the head end and the head relative to the shaft end and the shaft, said coupling structure including a stop portion fixed relative to the shaft and spaced from the head end and the head and engageable with the head end or the head to limit lateral displacement thereof.

15. The golf club of claim 14, wherein said stop portion includes a hollow shroud surrounding said flexing portion and spaced therefrom.

16. The golf club of claim 15, wherein said shroud is an elongated tubular member coaxially surrounding said flexing portion and fixed at one end thereof to said shaft end of said coupling structure.

17. The golf club of claim 16, wherein said shroud is circularly cylindrical in shape.

18. The golf club of claim 14, wherein said flexing portion has the same cross-sectional shape along substantially its entire length.

* * * * *